United States Patent [19]

Thomson

[11] 4,191,009

[45] Mar. 4, 1980

[54] ROPES AND THE LIKE

[75] Inventor: Ian M. Thomson, Wokingham, England

[73] Assignee: Cable Belt Limited, England

[21] Appl. No.: 956,607

[22] Filed: Nov. 1, 1978

[30] Foreign Application Priority Data

Nov. 11, 1977 [GB] United Kingdom ..... 46953/77

[51] Int. Cl.[2] ..... B65H 69/06; D02G 3/40

[52] U.S. Cl. ..... 57/202; 57/22

[58] Field of Search ..... 57/22, 202; 403/274, 403/279, 289, 291, 292

[56] References Cited

U.S. PATENT DOCUMENTS

| | | | |
|---|---|---|---|
| 1,656,258 | 1/1928 | Yale | 57/22 X |
| 2,482,204 | 9/1949 | Peterson | 57/202 |
| 2,703,300 | 3/1955 | Koon | 57/202 |
| 3,634,972 | 1/1972 | Illman | 57/202 |
| 3,904,458 | 9/1975 | Wray | 57/202 X |

*Primary Examiner*—Donald Watkins

*Attorney, Agent, or Firm*—Leydig, Voit, Osann, Mayer & Holt, Ltd.

[57] ABSTRACT

A method is disclosed of splicing together two rope lengths each of which is made up of a plurality of strands individually covered with thermoplastic material. Each alternate strand of each rope length is unwound back to a predetermined point and one of the strands of the other rope length is wound in its place back to that point. This process is repeated for each of the other strands, with the respective points at which the winding and unwinding process is terminated being spaced apart along the length of the splice with respect to each other. At each of these points, the end regions of the two strands of each pair at that point are placed together and then bonded together by means of their coverings of thermoplastic material. An outer covering of thermoplastic material may then be placed over the entire splice.

10 Claims, 5 Drawing Figures

ROPES AND THE LIKE

BACKGROUND OF THE INVENTION

The invention relates to rope, which term is intended to embrace elongate flexible products made of various different types of material and includes products sometimes known as wires or cables; and more specifically the invention relates to methods of joining two rope lengths together by splicing and to rope lengths so joined.

It is known to join two rope lengths together by a splicing method which comprises the step of unwinding, back to a predetermined point, each alternate one of the strands of one of the rope lengths, and then winding in its place one of the strands of the other rope length. At the point where this winding and unwinding process is terminated, there will, of course, be two loose strand ends, and it is known to deal with these loose ends by removing a short length of the center core strand at that point, and then to tuck the loose ends into the space previously occupied by this removed center core strand portion. This splicing method is unsatisfactory in that the strand ends cross over each other before entering the rope center. This distorts the rope at this point, and also gives the rope a greater diameter there, and it is in fact this point at which maximum, or at least increased, wear and wire breakage can take place.

It is an object of the invention, therefore, to provide an improved method of splicing together two rope lengths.

It is another object of the invention to provide an improved rope splice.

BRIEF SUMMARY OF THE INVENTION

In accordance with the invention, there is provided a method of splicing two rope lengths together, where each rope length comprises a plurality of strands each covered with an individual sheath of thermoplastic material, comprising the steps of bringing the two rope lengths together, unwinding each alternate strand of each rope length and winding in its place one of the strands of the other rope length, terminating this winding and unwinding process for each pair of strands at a difference respective point along the splice, leaving the end of at least one of the said pair of strands at each said point not tucked into the rope length, placing the end regions of the two strands of each pair together at each point, and bonding the two end regions together by means of their coverings of thermoplastic material.

Also provided according to the invention is a rope splice made by the foregoing method.

The covering of the strands with individual sheaths of thermoplastic material, and the use of this material to bond the two strand ends together at each said point, enables the length of the splice to be very considerably shortened compared with the known method. This is achieved because the thermoplastic material covering can provide greater frictional grip between the strands of the splice, and in addition enables the strand ends to be bonded together. Furthermore the strand ends at each said point can be placed together (for example, by having their ends butted together) in such a way that the overall diameter at each said point is not significantly greater than the diameter at any other point along the splice.

DESCRIPTION OF THE DRAWINGS

Method according to the invention of splicing rope lengths, and spliced ropes embodying the invention, will now be described, by way of example only, with reference to the accompanying diagrammatic drawing in which.

Figure 1:
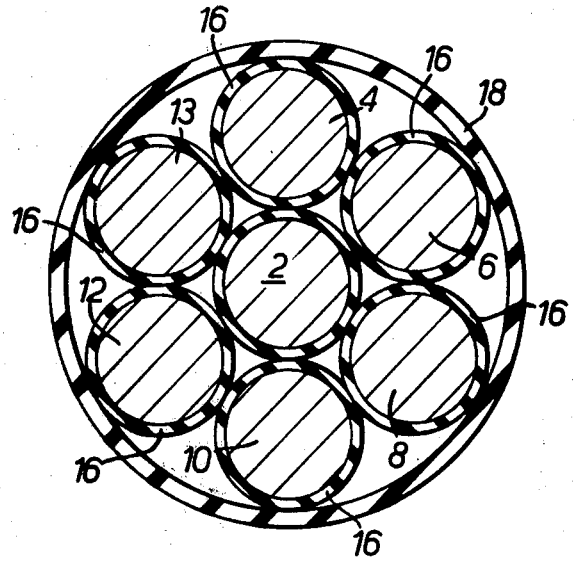
FIG. 1 is a diagrammatic cross-section through the rope.

The rope shown in FIG. 1 has a central or core strand 2 and six outer strands 4, 6, 8, 10, 12 and 13. Each strand is made up of a plurality of wires (omitted from the drawing for clarity) which are twisted around each other.

Each strand is covered with its own individual sheath 16 made of thermoplastic rubber or similar suitable material.

The strands 4 to 13 are then twisted around the core strand 2. Finally the entire rope is covered with an outer sheath 18 of thermoplastic rubber or similar suitable material.

FIGS. 2 to 5 illustrate the method of splicing together two rope lengths A and B (which may of course be the two ends of a single rope), each rope length being as described above with reference to FIG. 1.

Figure 2:
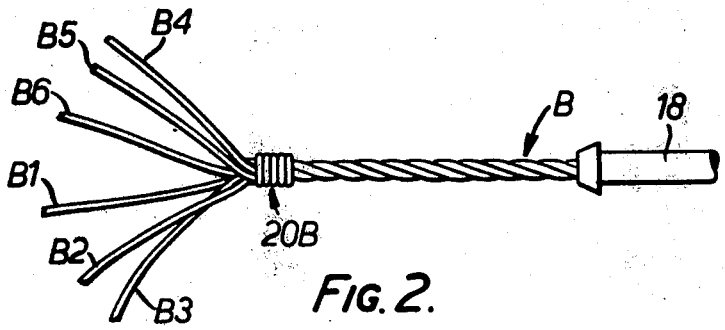
FIG. 2 is a diagrammatic side elevation of a rope length prepared for splicing.

On the assumption that the rope diameter is approximately 2.5 centimeters, the outer sheath 18 of each rope length A and B is stripped back for a distance of approximately 3.0 meters as shown for rope length B in FIG. 2, and bindings 20A and 20B are then applied as shown. The six strands (referred to as strands A1, A2, A3, A4, A5 and A6 for rope length A, and B1, B2, B3, B4, B5 and B6 for rope length B) are unwound back to the bindings 20A and 20B. If desired, alternate strands (e.g. A1, A3 and A5, and B2, B4 and B6) may be cut off in each rope length close to the respective binding 20A or 20B. The core strand 2 of each rope length A and B is then cut off at the respective binding 20A, 20B.

Figure 3:
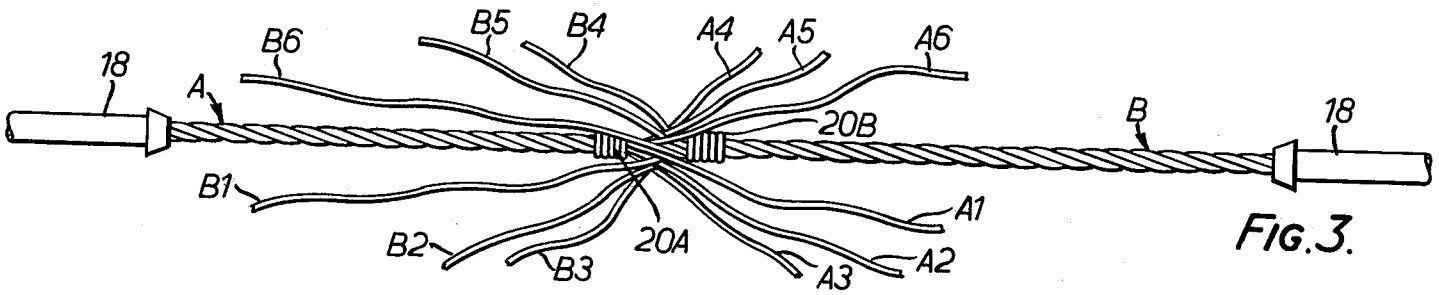
FIG. 3 is a diagrammatic side elevation of two rope lengths at an early stage in the splicing process.

The ends of the rope lengths A and B are now brought together with the strands interlocking in regular order as shown in FIG. 3, and the binding 20A is removed.

Figure 4:
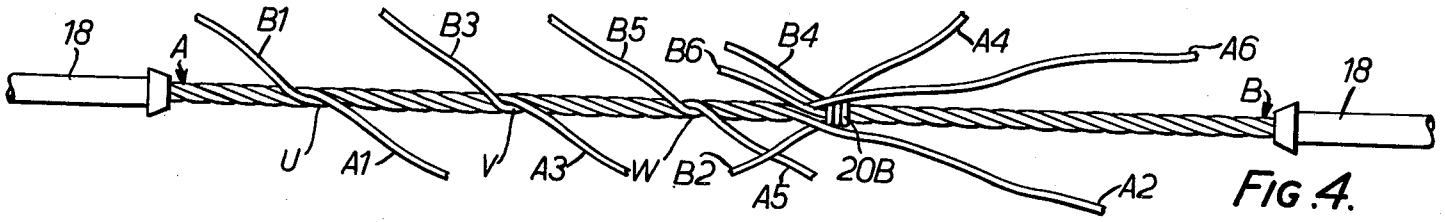
FIG. 4 is a view corresponding to FIG. 3 but showing an intermediate stage in the splicing process.

Strand A1 is then gradually unwound from the rope length A, and the corresponding strand B1 of the rope B is laid in its place until only about 25 centimeters of B1 remains unwound. Care should be taken that the strand B1 is accurately laid in the exact groove previously occupied by strand A1. The unwound strand A1 is cut off, leaving a loose end of about 25 centimeters, similar to that of strand B1. A temporary binding may be placed over the junction of the strands A1 and B1 at point U as shown in FIG. 4.

Strand A3 is then unwound from the rope length A and strand B3 laid in its place, in similar fashion to strands A1 and B1, and this process is carried back to a point V about 50 centimeters from point U. The loose ends of strands A3 and B3 are cut off to a length of about 25 centimeters, and again a temporary binding can be placed over the junction of the strands A3 and B3 and point V.

The same precedure is then carried out for strands A5 and B5, with strand A5 being unwound and strand B5 being wound in its place. This is carried back to a point W which is approximately 50 centimeters from the point V, and again binding can be placed around the rope at point W, and strand A5 and B5 are each cut off to a length of about 25 centimeters.

The splice now has the form shown in FIG. 3.

The binding 20B is then removed from the rope length and the procedure described above with regard to unwinding and winding of strands is then followed; that is, strand B2 is unwound and strand A2 wound in its place back to a point X, strand B4 is unwound and strand A4 wound in its place back to a point Y, and strand B6 is unwound and strand A6 is wound in its place back to a point Z. The loose end of each of these strands is cut off to a length of approximately 25 centimeters, and the spacing between point X and point Y and between point Y and point Z is approximately 50 centimeters in each case.

Figure 5:
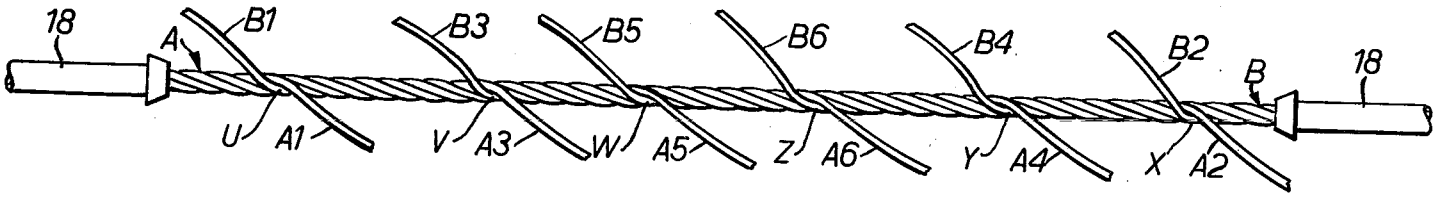
FIG. 5 is a view corresponding to FIG. 3 but showing a later stage in the splicing process.

FIG. 5 therefore shows the state of the splice at this stage.

It is now necessary to deal with the strand ends, and in fact these can be dealt with in a variety of ways.

First, the strand ends can be simply cut off and butted together. By the application of heat, the thermoplastic rubber covering on each strand can be softened at the point where it butts against the other strand, and in this way bonding is achieved. An overall thermoplastic covering, corresponding to the sheath 18, can then be placed over the entire splice to give added strength.

It may be advantageous for the thermoplastic material used for the overall covering to have a higher softening temperature than the thermoplastic material used for the sheaths 16 on the individual strands. Therefore, when the outer covering is applied and then raised to its softening temperature to bond, this will soften the thermoplastic material of the sheaths 16, bonding the whole structure together.

It is also possible to tuck into the centre of the rope each strand end which points in the direction of intended travel of the spliced rope. This process of course entails temporary opening out of the strands of the rope at the particular point, and removal of a short length of the core strand 2 (FIG. 1). The strand end pointing in the opposite direction to the direction of intended travel of the rope is then not tucked into the centre of the rope but is butted up to the leading strand where it enters the rope. As before, an outer covering of thermoplastic material would be placed over the finished splice.

Another possibility is to cut off the protruding pairs of strands so that they overlap each other within the rope diameter for a short distance, and to taper each of them over this distance so as to allow them to lie together, over the region of overlap, within the diameter of one strand. As before, the application of thermoplastic outer covering, corresponding to the sheath 18, over the whole splice, bonds the whole structure together.

Instead of tapering the overlapping lengths of the strands, each can be given a stepped reduction in diameter so that together, over the region of overlap, they have a total number approximately equal to the diameter of one strand. Again, an outer thermoplastic rubber covering would be provided, corresponding to the sheath 18, over the whole splice to bond the whole structure together.

At each point where strand ends protrude (and are dealt with in one or other of the various ways suggested above), the rope can be bound with wire or fibre for strengthening purposes.

Advantageously, at the splice the rope may be provided with one or more of various means for indicating wear or undue stretching or damage to the rope. For example, the colour of the outer sheath may be different from the colour of the sheaths 16, so that damage to the outer sheath is indicated visually by appearance of the colour of the sheaths 16.

Instead, or in addition, the outer sheath may be provided with a plurality of through cuts which open or close in the event of a change in dimension of the rope and indicate such change in dimension by revealing or hiding the constrasting colour of the material immediately underlying the sheath.

It will be appreciated that, in the example above for a rope having a diameter of approximately 2.5 centimeters, the length of the splice, approximately 3 meters, is substantially less than would be the case for a conventional wire rope. This shorter length of splice is permissible with the form of rope described because of the fact that the sheaths 16 have a higher coefficient of friction than does steel wire and, moreover, the sheaths 16 can be bonded together and to the outer sheath 18 in the manner described.

The individual strands to be joined together by bonding their thermoplastic sheaths together may be first treated with a suitable bonding agent to facilitate this.

The final covering of thermoplastic material over the entire splice may be applied in a series of short lengths. These may be alternately of material having relatively high and relatively low softening temperatures so as to facilitate their being bonded together end to end.

What I claim is:

1. A method of splicing two rope lengths together, where each rope length comprises a plurality of strands each covered with an individual sheath of thermoplastic material, comprising the steps of bringing the two rope lengths together, unwinding each alternate strand of each rope length and winding in its place one of the strands of the other rope length, terminating this winding and unwinding process for each pair of strands at a different respective point along the splice, leaving the end of at least one of the said pair of strands at each said point not tucked into the rope length, placing the end regions of the two strands of each pair together at each point, and bonding the two end regions together by means of their coverings of thermoplastic material.

2. A method according to claim 1, in which the bonding step is carried out so that the overall diameter of the splice at each said point is not substantially greater than elsewhere along the splice.

3. A method according to claim 1 or 2, in which the end regions of the two strands of each pair are placed together by butting their ends together.

4. A method according to claim 1 or 2, in which the end regions of the two strands of each pair are placed together by positioning them to overlap each other over a short region lying within the diameter of the splice, and reducing their respective diameters over the region of overlap so that their aggregate diameter is substantially the same as the normal diameter of one of the strands.

5. A method according to claim 1 or 2, in which one strand of each pair is tucked into the center of the rope length at each said point, and the end regions of the two strands of each pair are placed together by butting the other strand of each pair up against the said one strand.

6. A method according to claim 1 or 2, including the further step of applying an outer covering of thermoplastic material over the entire splice.

7. A method according to claim 6, in which the thermoplastic material for the outer covering has a higher softening temperature than the thermoplastic material covering each strand, whereby application of heat to soften the outer covering bonds the plastic material over the strands together.

8. A rope splice made by a method according to claim 1 or 2.

9. A rope splice, including two rope lengths spliced together, and in which:

each rope length comprises a plurality of strands each covered with an individual sheath of thermoplastic material, each alternate strand of each rope length being unwound at the splice back to a predetermined point and in its place being wound one of the strands of the other rope length up to the predetermined point, the predetermined points for each pair of strands being spaced apart along the splice, and the end regions of the two strands of each pair being placed together at each said point and having their coverings of thermoplastic material bonded together such that the overall diameter of the splice at each said point is not substantially greater than elsewhere along the splice.

10. A rope splice according to claim 9, including an outer covering of thermoplastic material over the entire splice.

* * * * *